United States Patent [19]

Steadman

[11] Patent Number: 4,835,916

[45] Date of Patent: Jun. 6, 1989

[54] FRAME FOR LIGHTED CEILINGS

[76] Inventor: Earl J. Steadman, P.O. Box 13, Toledo, Ohio 43692

[21] Appl. No.: 143,662

[22] Filed: Jan. 14, 1988

[51] Int. Cl.[4] ..... E04F 19/06

[52] U.S. Cl. ..... 52/28; 52/287; 52/288; 52/484; 52/488; 52/477; 52/633

[58] Field of Search ..... 52/287, 288, 484, 488, 52/633, 28, 476, 477; 403/230, 231, 232.1

[56] References Cited

U.S. PATENT DOCUMENTS

| | | | |
|---|---|---|---|
| 1,555,392 | 9/1925 | Tracy et al. | 52/288 |
| 1,691,179 | 11/1928 | Betz | 52/288 |
| 1,798,839 | 3/1931 | Gross | 52/573 |
| 3,748,804 | 7/1973 | De George | 52/488 |
| 3,898,782 | 8/1975 | Donato | 52/488 |
| 4,280,686 | 7/1981 | Wack | 403/232.1 |
| 4,598,516 | 7/1986 | Groshong | 52/287 |
| 4,729,074 | 3/1988 | Steadman | 362/148 |

FOREIGN PATENT DOCUMENTS

| | | | |
|---|---|---|---|
| 1108430 | 8/1955 | France | 52/633 |

*Primary Examiner*—James L. Ridgill, Jr.
*Attorney, Agent, or Firm*—Allen D. Gutchess, Jr.

[57] ABSTRACT

A supporting frame is provided for a light-transmitting ceiling panel, which panel extends to a vertical wall or other surface. The supporting frame is particularly designed for lighted ceilings in which light transmitting panels extend from wall to wall in a room and have sources of light thereabove. The supporting frame includes a side frame member having a horizontal flange which supports an edge of the light-transmitting panel and a vertical flange extending along a surface of the wall or vertical surface. The frame member is affixed to the vertical wall by suitable means extending through the vertical flange and the vertical flange also has indentations and/or openings to aid in affixing joint compound or the like thereto. In a preferred form, the supporting frame member has a shoulder formed at the junction of the vertical and horizontal flanges to which the joint compound or the like is spread when it is applied to the vertical flange and over the adjacent vertical surface of the wall. In a preferred form, the side frame member also has a second vertical flange which is parallel to the first and through which fasteners are also placed to further affix the frame side member to the vertical surface.

20 Claims, 2 Drawing Sheets

FRAME FOR LIGHTED CEILINGS

This invention relates to a supporting frame for a light-transmitting panel and particularly for a light-transmitting ceiling panel having an edge adjacent a vertical surface.

Rooms with lighted ceilings where the entire ceiling is made up of light-transmitting panels with light sources above then are quite common and perhaps are becoming moreso. In such a ceiling, some of the light-transmitting panels have edges positioned adjacent vertical surfaces of the room at the periphery thereof. It has been found that with such ceiling, a not uncommon occurrence is for light to lead downwardly along the vertical surface, between the surface and the frame supporting the edge of the light-transmitting panel. This detracts seriously from the overall appearance and can make an expensive ceiling look quite the opposite. Narrow gaps between the supporting frame and the vertical surface can also detract from the appearance of the ceiling even if light leakage is not a problem.

The present invention provides a supporting frame for a light-transmitting panel in a ceiling which achieves a smooth joint between the lighted ceiling and vertical surface of a room, such as a vertical side wall thereof. The supporting frame includes a side frame member which is located along the vertical surface for supporting an edge of one of the light-transmitting panels. The frame member has a first vertical flange which has a length at least equal to the length of the edge of the light-transmitting panel and has a width exceeding the thickness of the panel. The frame member can have a second vertical flange which has a length at least equal to the length of the edge of the panel and is parallel with the first vertical flange. A horizontal flange which also has a length at least equal to the length of the edge of the panel extends outwardly from the first vertical flange at an upper edge thereof and supports the edge of the light-transmitting panel. The first vertical flange has means in the form of indentations and/or openings which provide increased adherence with joint compound or the like which is spread over the flange and spread smoothly over adjacent portions of the vertical surface to which the frame member is attached. Preferably, a shoulder is provided at the junction of the first vertical flange and the horizontal one up to which the joint compound is spread to provide a smooth appearance.

The supporting frame member can be made of one sheet of metal with the horizontal flange being doubled back. End portions of one of the doubled-black layers can then be removed so that the frame members provide a smooth joint when ends of them meet at a corner of the room. Intermediate frame members of inverted T-shaped configuration can also be employed with the ceiling with a horizontal flange of the intermediate frame member being doubled back. End portions of one layer can then be removed along with an upper layer of intermediate portion so the horizontal flange of the side frame member, whereby the intermediate and side frame members again provide a smooth appearance at the intersection or joint.

The supporting frame can also be employed with a vertical surface of an upper partition or wall between two rooms, with the two vertical flanges then being received on opposites sides of that wall over a lower edge thereof.

It is, therefore, a principal object of the invention to provide a lighted ceiling for a room which has a smoother and more finished appearance than many of those heretofore known.

Many other objects and advantages of the invention will be apparent from the following detailed description of preferred embodiments thereof, reference being made to the accompanying drawings, in which.

Figure 1:
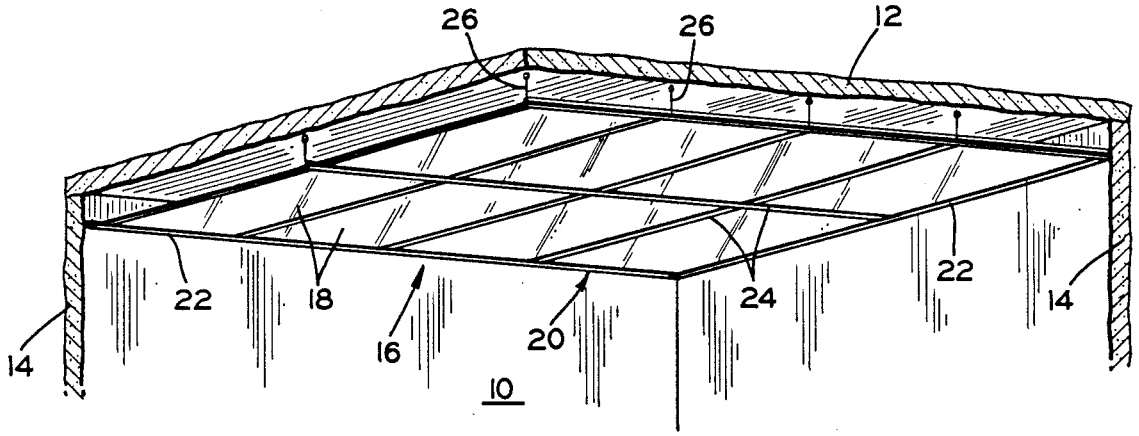
FIG. 1 is a schematic view in perspective of a room with a lighted ceiling embodying the invention.
Figure 2:
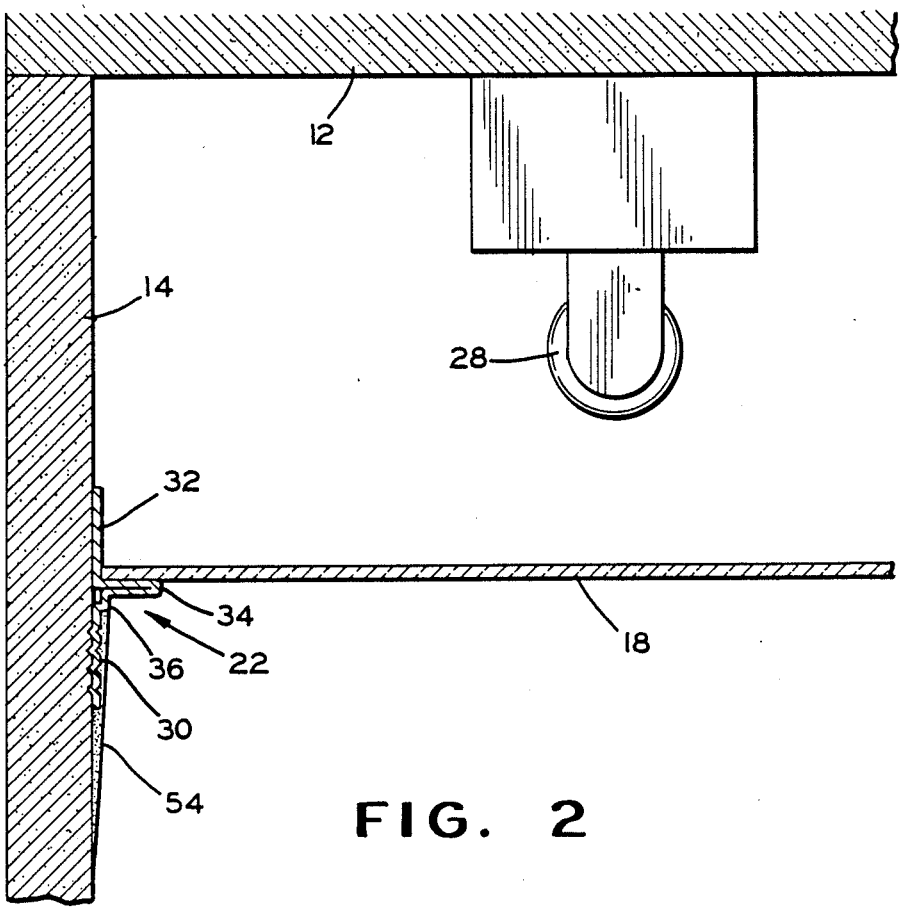
FIG. 2 is a greatly enlarged, somewhat schematic view in vertical cross section taken through an edge portion of the room and ceiling of FIG. 1.

Referring to the drawings, and particularly to FIG. 1, a room 10 has a structural ceiling 12 and side walls 14. A lighted ceiling indicated at 16 is comprised of light-transmitting rectangular panels 19 and a supporting frame system 20. The system 20 includes side frame members 22 located along the side walls 14 and intermediate frame members 24. The intermediate frame members 24 are suspended from the ceiling 12 by suitable wires or hangers 26, as is well known in the art. Suitable sources 28 (FIG. 2) of light, such as fluorescent fixtures, are located above the ceiling panels 16.

The side frame members 22 include a first vertical flange 30 which extends at least the length of the panel 18 and can extend the width of the side wall 14 with which its is associated. The vertical flange 30 has a width which substantially exceeds the thickness of the light-transmitting panel 18. The side frame member 22 also has a second vertical flange 32 which is parallel to the first vertical flange 30 and, in this instance, is substantially coplanar therewith. A horizontal, intermediate flange 34 also extends at least the length of the edge of the panel 18 and extends outwardly from the upper edge of the vertical flange 30. In this instance, it also extends out from the lower edge of the vertical flange 32.

In a preferred form, the side frame member 22 is made of one strip or sheet or metal which is of single thickness at the vertical flanges 30 and 32 and is doubled back to form the horizontal flange 34. A ridge or shoulder 36 is also formed by the metal sheet at the junction of the first vertical flange 30 and the horizontal flange 34, and is coextensive with them lengthwise.

Figure 3:
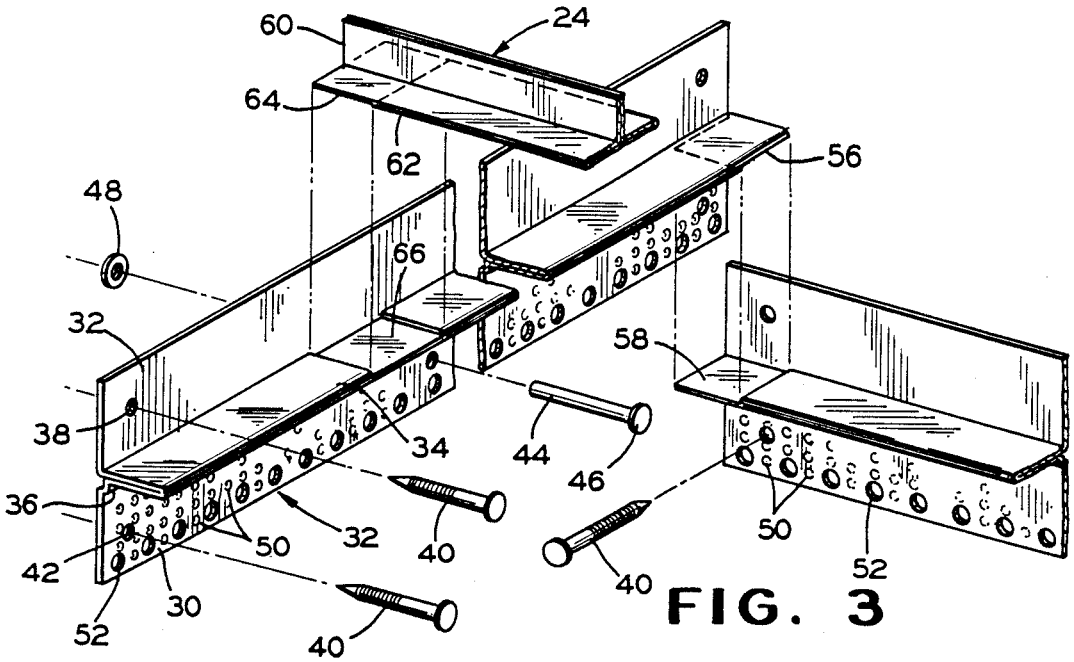
FIG. 3 is a fragmentary, exploded view in perspective of supporting frame members of the ceiling.

The upper vertical flange 32 is suitably affixed to the side wall 14 and can have preformed fastener holes 38 at predetermined locations therealong to receive suitable fasteners such as ring-shanked nails 40 (FIG. 3). These can be used at studs to fasten the frame member 22 through the wall surface to the studs.

The lower vertical flange 30 can also be affixed to the wall 14 and has pre-formed fastener openings 42 located therein. Fasteners in the form of pop rivets 44 with heads 46 and washers 48 can be employed to fasten the flange 32 to the wall 14 when it is constructed of plasterboard or the like. The washers 48 are not employed at the other side of the wall if not accessible. The ring-shanked nails 40 can also be employed wit the flange 30, particularly at the location of studs. The flange 30 preferably is fastened to the wall 14 at more closely spaced locations than the vertical flange 32 so that the fastener-receiving openings 42 are more closely spaced than are the openings 38 for the flange 32.

The lower vertical flange 30 also has dimples 50 therein to increase the surface of the flange area and increase the bond with joint compound. The flange also has a multiplicity of openings or perforations 52 along the lower edge thereof to receive joint compound which aids in holding the flange 32 adjacent the surface of the side wall 14. Flanges with similar dimples and edge holes or perforations are also shown and discussed in my co-pending applications Ser. No. 940,570, filed on Dec. 11, 1986. After the side frame member is mechanically affixed to the side wall 14, joint compound 54 (FIG. 2) is spread over the flange 30 and tapered off on portions of the surface of the side wall 14 below the flange. The joint compound 54 is spread up to the shoulder 36 which provides a smooth and straight terminal edge for the joint compound.

With this construction, it will be seen that there is no possibility of light leaking around the edges of the side frame members and no gaps will be apparent between the surface of the side wall 14 and the side frame member in the event of unevenness in the side wall surface, as occurs upon occasion, perhaps moreso than is desirable. Further, the surface of the side wall 14 with the tapered joint compound 54 is smooth and unbroken up to the shoulder 36 at the horizontal flange 34.

At one end of the horizontal flange 34, the lower layer of metal is removed to leave a downwardly-facing shallow notch or recess 56. At the other end, the upper layer of metal is removed to leave an upwardly-facing shallow notch or recess 58. These enable the side frame members 22 to meet in smooth, overlapping relationship at the corners to enhance the seamless appearance of the edges of the ceiling.

The intermediate frame members 24 are of generally inverted T-shaped configuration, as is known in the art. Each of these includes a vertical flange 60 and a horizontal flange 52. They can also be made of a single sheet of metal which is doubled to provide a double-thick layer for both of the flanges 60 and 62. A lower layer of the metal can be removed at an end portion to provide a downwardly-facing notch or recess 64. Intermediate portions of the upper layer of the metal of the horizontal flange 34 can also be removed to leave notches or recesses 66 at appropriate locations to receive the ends of the intermediate frame members 24, providing a smooth overlapping joint at this juncture.

The intermediate frame members 24 and even the side frame members 22 also can be molded of a translucent plastic material to provide a distinctive appearance for the ceiling. In such an instance light is transmitted through the frame members as well as through the light-transmitting panels 18.

Figure 4:
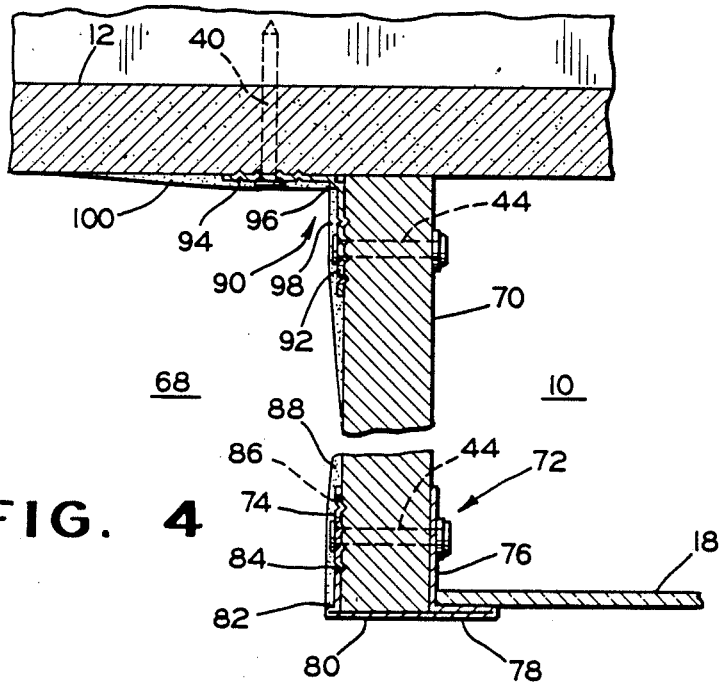
FIG. 4 is a view in vertical cross section similar to FIG. 2 showing a modified room structure and supporting frame.
Figure 5:
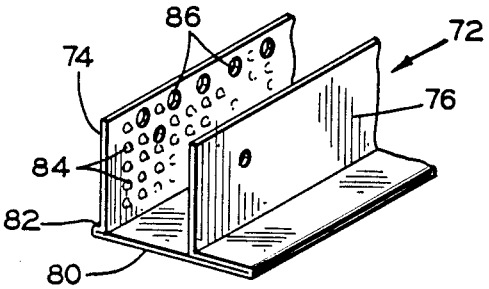
FIG. 5 is a fragmentary view in perspective of a supporting frame member of FIG. 4.
Figure 6:
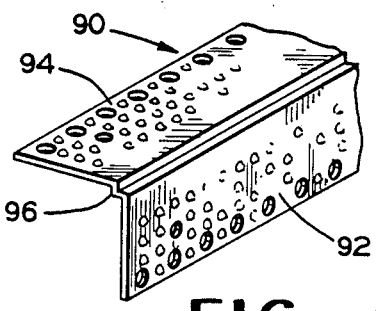
FIG. 6 is a fragmentary view in perspective of another frame member of FIG. 4.

At times, a room may be provided with a lighted, suspended ceiling contiguous to a room with a conventional ceiling. Ordinarily, this is not a problem with side walls therebetween. However, in some instances, the doorway between the rooms may extend upwardly to the original ceiling. In that instance, the suspended ceiling must be closed off at the doorway. An example of this installation is shown schematically in vertical section in FIG. 4. Here, the room 10 with the suspended ceiling is located adjacent a room 68 with the original ceiling 12. A vertical wall or partition 70 is suitably mounted at the upper end of the doorway by wooden frame members (not shown) with this wall extending perpendicularly to and in contact with the ceiling 12. A specially-shaped supporting frame member 72 is then mounted at the lower edge of the wall 70, in alignment with others ones of the side frame members 22 in the room 10. The supporting frame member 72 includes a first vertical flange 74 which extends the width of the door opening or the width of the edge of the panel 18, and has a width exceeding the thickness of the panel 18. This flange is positioned adjacent a vertical surface of the wall 70. The frame member 72 includes a second vertical flange 76 which is parallel to the first flange 74 and, in this instance, is located adjacent the other vertical surface of the other wall 70. A horizontal flange 78 extends outwardly from the lower edge of the first vertical flange 74 to support the edge of the panel 18. In this instance, the flange 78 also includes a web 80 which extends to the second vertical flange 76 with a ridge or shoulder 82 formed at the juncture with the flange 74. The vertical flange 74 can be provided with indentations 84 and perforations or holes 86 to enhance adhesion with the joint compound or the like in the same manner as the vertical flange 30 of the side frame member 22. Joint compound 88 can be spread over the flange 74 and over portions of the adjacent surface of the wall 70. The supporting frame member 72 can be affixed to the wall 70 by the pop rivets 44 or other suitable fasteners.

At the juncture of the wall 70 and the original ceiling 12, a corner frame member 90 can be employed having two mutually perpendicular vertical and horizontal flanges 92 and 94 meeting with a shoulder or ridge 96. Joint compound 98 and 100 is spread over the respective vertical and horizontal flanges 92 and 94 and over adjacent portions of the surface of the wall 70 and the ceiling 100. This compound is spread to the shoulder 96 to again provide a smooth and seamless joint. Both of the flanges 92 and 94 have indentations and perforations for the joint compound. As shown, the flange 92 is affixed to the wall 70 by the pop rivets 44 and the flange 94 is affixed to the ceiling 12 by the ring-shanked nails 40.

Various modifications of the above-described embodiments of the invention will be apparent to those skilled in the art and it is to be understood that such modifications can be made without departing from the scope of the invention, if they are within the spirit and the tenor of the accompanying claims.

I claim:

1. In combination, a light-transmitting panel in a ceiling, which panel extends to a side wall of a room, a supporting frame comprising a side frame member to be located along the side wall for supporting an edge of the light-transmitting panel, said frame member having a first vertical flange extending at least the length of the edge of the panel and having a width exceeding the thickness of the panel, said frame member having a second vertical flange extending at least the length of the edge of the panel, extending upwardly from said first vertical flange, and being substantially in coplanar relationship with respect thereto, a horizontal, intermediate flange extending at least the length of the edge of the panel and extending outwardly from said flanges at an upper edge of said first flange and at a lower edge of said second flange, to support the edge of the panel relative to the side wall, said horizontal, intermediate flange being smooth and unbroken throughout its length and width, and being exposed below said panel.

2. The combination according to claim 1 characterized by said second vertical flange having fastener openings formed therein to receive fasteners for affixing said second vertical flange to the side wall.

3. The combination according to claim 1 characterized by said frame member having a shoulder at the junction of said first vertical flange and said horizontal flange and extending the lengths thereof.

4. The combination according to claim 1 characterized further by an intermediate frame member of inverted T-shaped configuration having a double thickness horizontal flange with a lower layer of an end portion of the horizontal flange removed, an intermediate portion of an upper layer of the horizontally-extending flange of said side frame member also being removed whereby said intermediate frame member can be supported on said side frame member in smoothly overlapped relationship.

5. The combination according to claim 1 characterized by said first vertical flange having fastener openings formed therein to receive fasteners for affixing said first vertical flange to the side wall.

6. The combination according to claim 5 characterized by said second vertical flange having fastener openings formed therein to receive fasteners for affixing said second vertical flange to the side wall.

7. The combination according to claim 1 characterized by said frame member being constructed of one sheet of metal, with the metal being doubled back to form said horizontal flange.

8. The combination according to claim 7 characterized by an end portion of one layer of the sheet metal of said horizontal flange being removed whereby the end portions can be smoothly overlapped with horizontal flanges of other frame members.

9. The combination according to claim 1 characterized by said first vertical flange having means to aid in affixing joint compound or the like thereto.

10. The combination according to claim 9 characterized by said means comprising a plurality of indentations in said first vertical flange.

11. The combination according to claim 10 further characterized by said means further comprising a plurality of openings along the lower edge of said first vertical flange.

12. In combination, a light-transmitting panel in a ceiling, which panel extends to a side wall of a room, a light fixture located above said panel, a supporting frame for said panel comprising a side frame member located along the side wall for supporting an edge of the light-transmitting panel, said frame member having a vertical flange extending at least the length of the edge of said panel, and extending downwardly from said panel, a horizontal flange extending at least the length of the edge of said panel and extending outwardly from said vertical flange at an upper edge thereof to support the edge of the panel relative to said side wall, said horizontal flange being smooth and unbroken throughout its length and width, and being exposed below said panel, fastener means affixing said vertical flange to said side wall, said vertical flange having means to aid in affixing joint compound or the like thereto, and joint compound or the like covering said vertical flange and extending over adjacent portions of the surface of the side wall.

13. The combination according to claim 12 characterized by said vertical flange having a shoulder at the junction with said horizontal flange, said joint compound or the like extending to and abutting said shoulder.

14. The combination according to claim 13 characterized by said means comprising a plurality of indentations in said vertical flange.

15. The combination according to claim 14 characterized further by said means further comprising a plurality of openings in said vertical flange along the lower edge thereof.

16. In combination, a light-transmitting panel in a ceiling, which panel extends to a vertical surface of the room, a supporting frame comprising a side frame member to be supporting at the vertical surface for supporting an edge of the light-transmitting panel, said frame member having a first vertical flange extending at least the length of the edge of the panel and having a width exceeding the thickness of the panel, said frame member having a second vertical flange extending at least the length of the edge of the panel and being parallel with respect to said first vertical flange, a horizontal flange extending at least the length of edge of the panel and extending outwardly from an edge of the said first vertical flange to support the edge of the light-transmitting panel relative to said vertical surface, said horizontal flange being smooth and unbroken throughout its length and width, and being exposed below said panel.

17. The combination according to claim 16 characterized by said horizontal flange being connected to an edge of said second vertical flange.

18. The combination according to claim 16 characterized by said first vertical flange having means to aid in affixing joint compound or the like thereto.

19. The combination according to claim 18 characterized by said frame member having a shoulder at the junction of said first vertical flange and said horizontal flange.

20. The combination according to claim 19 characterized by joint compound or the like covering said first vertical flange and extending over adjacent portions of the surface of said vertical panel.

* * * * *

UNITED STATES PATENT AND TRADEMARK OFFICE

CERTIFICATE OF CORRECTION

PATENT NO. : 4,835,916

DATED : June 6, 1989

INVENTOR(S) : Earl J. Steadman

It is certified that error appears in the above-identified patent and that said Letters Patent is hereby corrected as shown below:

Column 1, line 14, change "ceiling" to --ceilings--.

Column 2, line 26, change "19" to --18--.

Column 2, line 49, change "or" (second occurrence) to --of--.

Column 2, line 68, change "wit" to --with--.

Column 3, line 14, change "applications" to --application--.

Column 6, line 28, claim 16, line 4, change "supporting" to --supported--.

Signed and Sealed this

Thirtieth Day of January, 1990

*Attest:*

JEFFREY M. SAMUELS

*Attesting Officer*

*Acting Commissioner of Patents and Trademarks*